US006836282B2

(12) United States Patent
Vosseler et al.

(10) Patent No.: US 6,836,282 B2
(45) Date of Patent: Dec. 28, 2004

(54) LASER IMAGING WITH VARIABLE PRINTING SPOT SIZE

(75) Inventors: Bernd Vosseler, Heidelberg (DE); Bernard Beier, Ladenburg (DE); Uwe Ernst, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/911,206

(22) Filed: Jul. 23, 2001

(65) Prior Publication Data

US 2002/0044196 A1 Apr. 18, 2002

(30) Foreign Application Priority Data

Jul. 24, 2000 (DE) ..... 100 35 848

(51) Int. Cl.[7] ..... B41J 2/435
(52) U.S. Cl. ..... 347/247
(58) Field of Search ..... 347/233, 237, 347/239, 247, 253–255; 359/694, 822, 823

(56) References Cited

U.S. PATENT DOCUMENTS

| | | | | |
|---|---|---|---|---|
| 4,612,555 A | | 9/1986 | Hongou et al. | 347/247 |
| 5,153,916 A | * | 10/1992 | Inagaki et al. | 382/151 |
| 5,605,097 A | | 2/1997 | Ruckl et al. | 101/128.4 |
| 5,666,577 A | * | 9/1997 | McIntyre et al. | 396/296 |
| 5,764,272 A | | 6/1998 | Sarraf | 347/246 |
| 5,819,661 A | | 10/1998 | Lewis et al. | 101/467 |
| 5,822,345 A | | 10/1998 | Sousa et al. | 372/38 |
| 6,025,867 A | * | 2/2000 | Buus | 347/262 |
| 6,072,511 A | * | 6/2000 | Mueller et al. | 347/131 |

FOREIGN PATENT DOCUMENTS

| | | |
|---|---|---|
| EP | 0476863 | 3/1992 |
| EP | 0679510 | 11/1995 |
| EP | 0818858 | 1/1998 |
| EP | 0922573 | 6/1999 |
| JP | 59146068 | 8/1984 |
| WO | 9727065 | 7/1997 |

* cited by examiner

*Primary Examiner*—Michael Nghiem
(74) *Attorney, Agent, or Firm*—Davidson, Davidson & Kappel, LLC

(57) ABSTRACT

A device for spotwise imaging printing surfaces includes a laser light source producing at least one laser beam movable relative to a printing surface, the laser beam defining an image spot on the printing surface, the laser beam having a laser power. A laser control varies the laser power or an exposure time as a function of a distance of the laser light source from the image spot.

9 Claims, 6 Drawing Sheets

LASER IMAGING WITH VARIABLE PRINTING SPOT SIZE

BACKGROUND INFORMATION

The present invention relates to a device for the spotwise imaging of printing surfaces with the aid of at least one laser beam which is moved relative to the printing surface.

During the imaging of printing plates in CtP (computer-to-plate) or direct-imaging printing machines, the spacing between the printing surface and the optical system of the imaging device has to be maintained very accurately to obtain an optimum result. However, deviations from the intended distance between the printing surface and the imaging laser arise, for example, because of oscillations of the machine during operation. The extent to which the quality of the imaging result depends on the deviation from the intended distance is determined, inter alia, by the beam quality of the laser and the selected beam parameters. A deviation from the intended distance generally gives rise to a deformed printing spot which is either larger or smaller than the predefined nominal size results form, depending on the beam parameters. In the case of very large deviations, even no printing spot is generated at all on the printing surface because the laser beam is widened to such an extent that the imaging threshold is no longer reached at any location of the printing surface.

U.S. Pat. No. 5,764,272 discloses an autofocus system for a laser imaging device. This system has a laser and a corresponding optics for forming a light beam which is focused on an image plane. Via a photodiode, a signal which is characteristic of the light reflected from the image surface is generated so that the focus of the laser beam on the image surface can be correspondingly adapted to the characteristic signal. In this manner, a close association of the image surface and the image plane of the laser including its corresponding optics is brought about. For shifting the focus of the imaging device, it is possible to move the laser, the corresponding optics or the image surface.

Autofocus systems of this kind can work only at limited speeds. For example, if the laser optics is moved, it is required for a mass that is not negligible to be quickly accelerated, accurately positioned, and quickly decelerated again. For high-frequency disturbances such those that arise, for example, due to dirt accumulations under the printing surface, dust particles or because of folds in the printing surface, the control times needed by such a system are too long. Therefore, imaging defects occur frequently. In a multichannel system, i.e., an imaging device having a plurality of parallel laser beams, it is typically not possible to focus each individual beam since the whole imaging optics is moved. In other words: a compromise must be found so that the deviation from the intended distance of all simultaneous beams altogether becomes minimal. Generally, the design of a mechanical autofocus system which functions by moving the imaging optics requires considerable technical outlay, a corresponding constructional space, and causes a relatively great expense.

SUMMARY OF THE INVENTION

An object of the present invention is to provide a device for the spotwise imaging of printing surfaces with the aid of at least one laser beam which is moved relative to the printing surface and which makes it possible to carry out a variable imaging without having to mechanically move parts of the device such as the imaging optics to compensate for variations in the distance between the imaging optics and the printing surface.

This objective may be achieved by a device for the spotwise imaging of printing surfaces with the aid of at least one laser beam which is moved relative to the printing surface, wherein a laser control (426) is included which varies the laser power or the exposure time as a function of the distance of the laser light source (40) from the image spot (410).

The present invention also provides a method for the imaging of printing surfaces with the aid of at least one laser beam comprising the steps of:

providing a laser light source (40) for generating a laser beam (42) having a position-dependent intensity distribution in the two spatial directions perpendicular to the propagation axis, and a specific divergence;

providing a printing surface (48) at a distance from the laser light source (40);

exposure of the printing surface (48) located at a certain distance from the laser light source (40); characterized by the variation of the laser power or exposure time for varying the spot size of image spots (410) on the printing surface (48).

The present invention in addition provides a method for generating printing spots of desired size comprising the steps of: providing a laser light source (40) for generating a laser beam (42) having a position-dependent intensity distribution in the two spatial directions perpendicular to the propagation axis, and a certain divergence; and providing a printing surface (48) at a distance from the laser light source (40); characterized by the measurement of the distance of the laser light source (40) from the printing surface (48); and the adjustment of the spot size to a predetermined value by varying the laser power or exposure time.

The imaging optics of an imaging device is typically adjusted in such a manner that, at the intended distance, the focus, i.e., the plane in which the laser beam has its smallest diameter comes to rest exactly on the surface of the printing surface. A deviation from the intended distance between the laser and the printing surface results in an increase in the beam diameter on the printing surface and, consequently, in an increase or reduction in size of the printing spot, depending on the adjustment of the laser parameters of power and focus diameter. The actual distance between the printing surface and the laser is measured by means of a detector so that it can be compared to a setpoint value. The optical power used for imaging is increased or reduced as a function of the deviation from the setpoint value. An increase in the laser power is associated with an increase in size of the printing spot since the spot size on which energy exceeding the imaging threshold is deposited on the printing surface increases. Correspondingly, a reduction in the laser power is associated with a reduction in size of the printing spot since the spot size on which energy exceeding the imaging threshold is deposited on the printing surface decreases.

A further way of varying the size of the printing spot is to selectively prolong or shorten the exposure time. A combination of the change in the power and in the exposure time is also possible.

Using the device according to the present invention, the increase or reduction in size of the printing spot due to a deviation in distance can be compensated for: via the provided variable laser power, it is possible to adapt the printing spot size so that an acceptable imaging result is attained. In other words: the printing spot size is variable. The value of the required optical power or exposure time can be computed from the measured distance. This function can be carried out, for example, in the raster generator which converts the printing spot pattern to be imaged into a time sequence of pulses for the laser imaging. In an advantageous manner, a table, a so-called "lookup table", is prepared and stored in the preliminary stages via the functional relation so that the required value is immediately available in situ.

In an advantageous refinement of the present invention, the device for the spotwise imaging of printing surfaces has a plurality of laser beams which are used for simultaneous imaging. In this context, in particular individually controllable diode laser arrays are given preference. The power or the imaging time can be varied for each individual laser of the array, making it possible to attain an acceptable imaging result since the size of each printing spot written by a laser is variable and independent of the size of the other printing spots.

The present invention requires considerably fewer moving parts than the known autofocus systems and can therefore react much more quickly to disturbances. At the same time, it attains a markedly better imaging result than a device without autofocus. The implementation of compact imaging devices in an integrated form is markedly easier. It involves lower cost.

A device of this kind can be used inside or outside of a printing unit or a printing machine for spotwise imaging.

BRIEF DESCRIPTION OF THE DRAWINGS

Further advantages and expedient embodiments of the present invention will be described on the basis of the following Figures and their descriptions.

Specifically.

DETAILED DESCRIPTION

Figure 1:
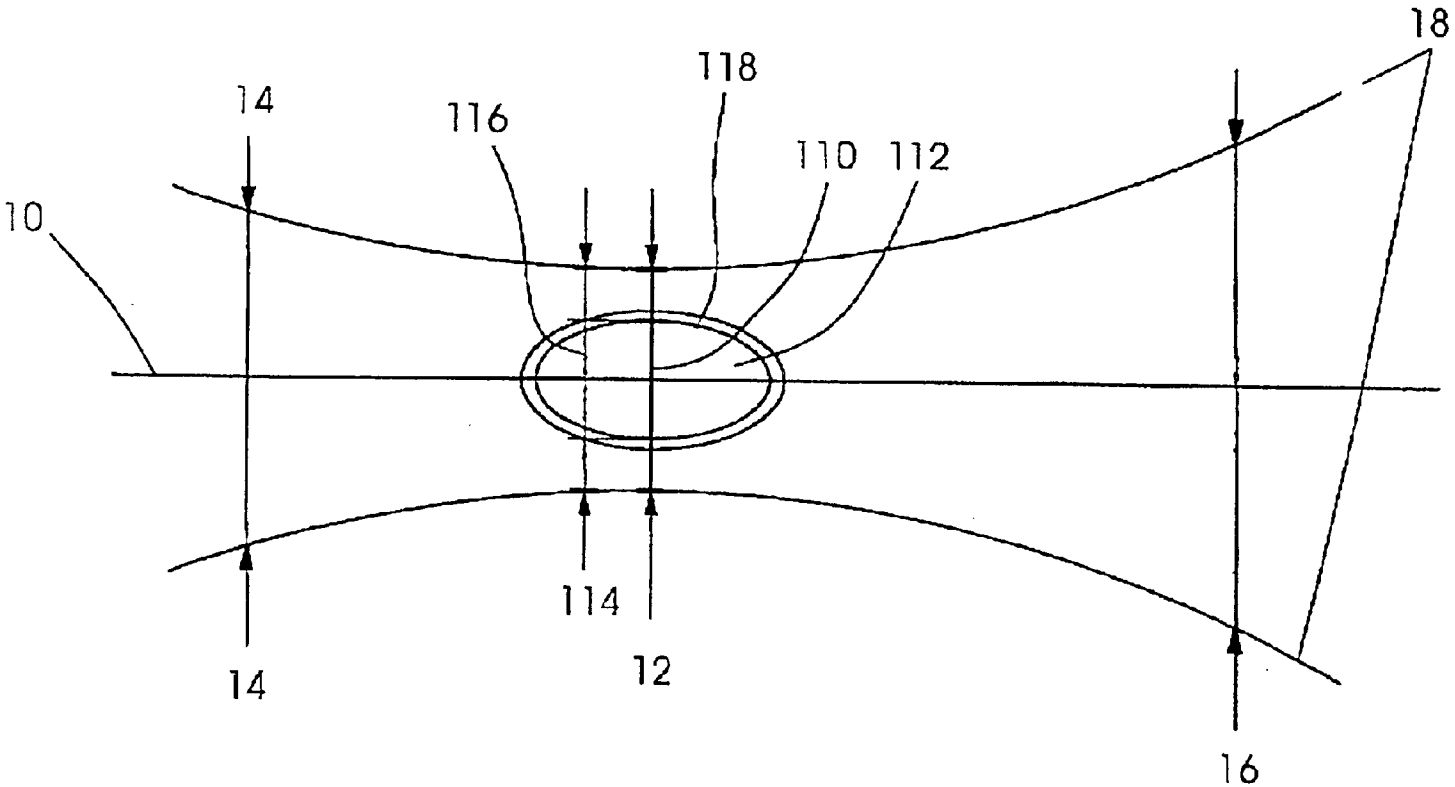
FIG. 1 shows the variation in the spot size of a laser beam.

FIG. 1 shows the variation in the spot size of a laser beam for the spotwise imaging of printing surfaces. The laser beam propagates along optical axis 10 on which, in addition, its intensity maximum is located. In focus 12, the laser beam has its smallest waist. An imaging is advantageously carried out at this point. In other words: focus 12 defines the intended distance of the laser from the printing surface. Both at a point 14 in front of the focus and at a point 16 behind the focus, the beam is widened. Lines 18 indicate the variation in the boundary of the light spot as a function of the position along the propagation direction. In focus 12, a greater intensity than the threshold intensity for imaging is reached in a region 110. Because of the widening of the laser beam in front of and behind focus 12, the region in which the intensity exceeds the threshold intensity becomes smaller since the conveyed energy flows through a larger cross-sectional area. Thus, if the laser intensity is maintained, region 112 results in which the imaging threshold is exceeded. In case of a shortened actual distance 114 from the laser to the printing surface, region 116 to be imaged is larger than region 112 attained with maintained intensity. According to the present invention, the intensity of the laser is consequently increased so that the region in which the threshold intensity for imaging is exceeded increases. The threshold intensity is then exceeded in the whole region 118. At actual distance 114, the threshold intensity is then reached in the whole region 116.

Figure 2:
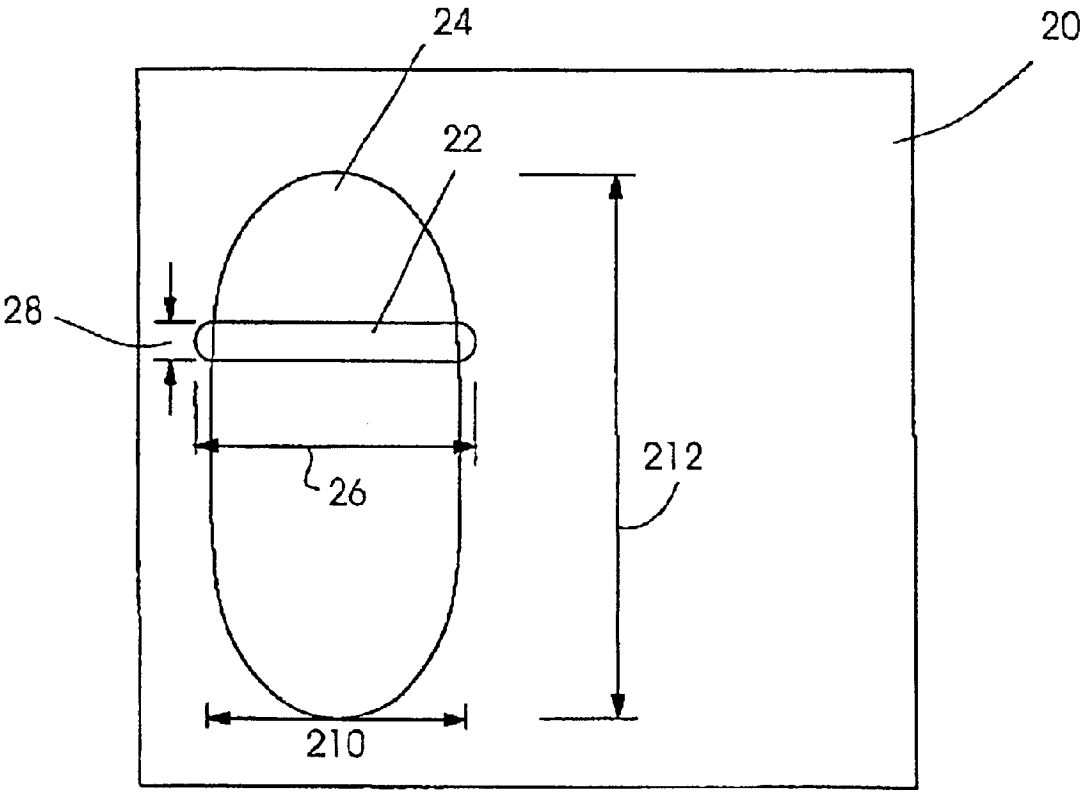
FIG. 2 shows the generation of a printing spot on a printing surface by moving a laser beam relative to the printing surface.

FIG. 2 shows the generation of a printing spot by moving a laser beam relative to a printing surface. A laser beam impinges on a printing surface 20 with a spot 22. The laser is scanned across printing surface 20 in such a manner that the threshold intensity for imaging is exceeded in the whole region 24. In a preferred embodiment, an elliptical Gaussian laser beam having two different semiaxes is used. In this context, longer spot diameter $w_x$26 typically lies perpendicularly to the moving direction. Shorter spot diameter $w_y$28 lies in the moving direction. Using a device of that kind, it is possible to write both lines and spots since printing spot width $d_x$210 and printing spot height $d_y$212 can be selected correspondingly.

Figure 3A:
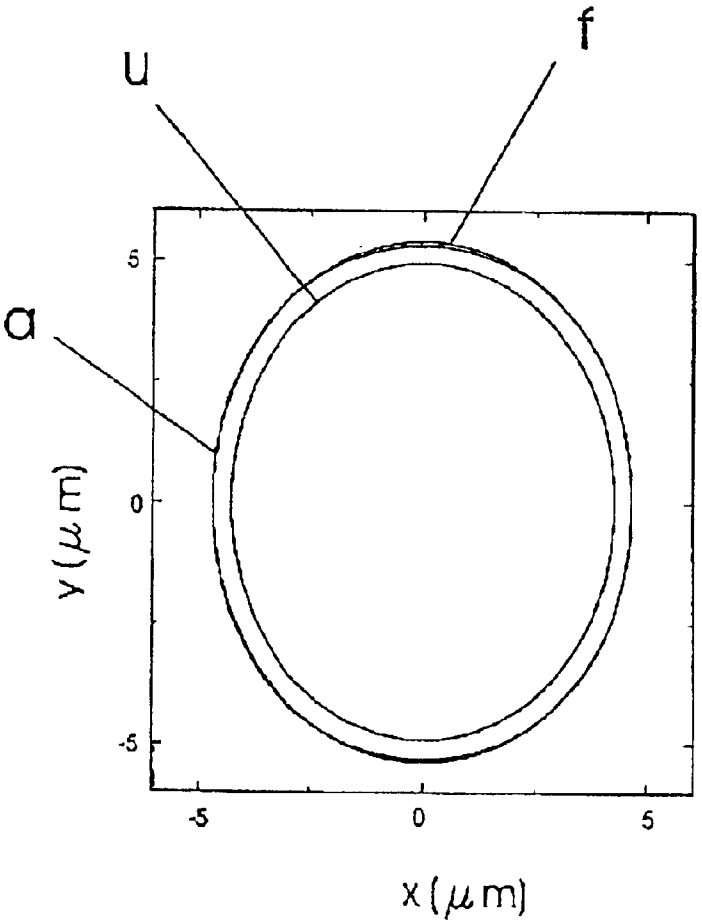
FIG. 3 shows examples of written printing spots with different laser parameters.
Figure 3B:
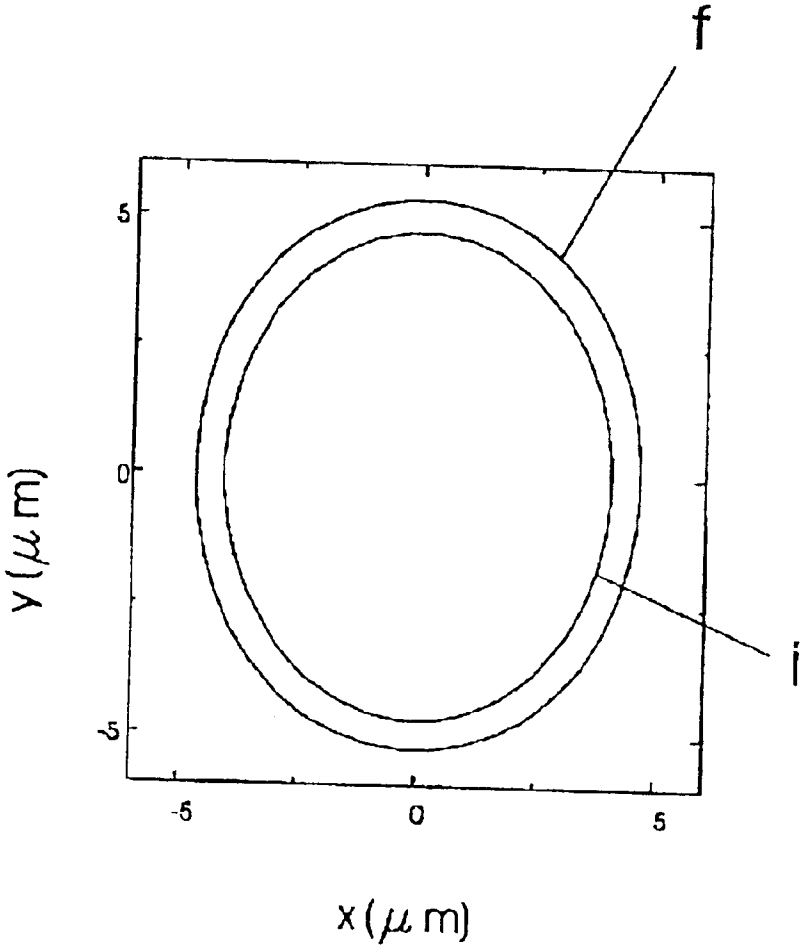
Figure 3C:
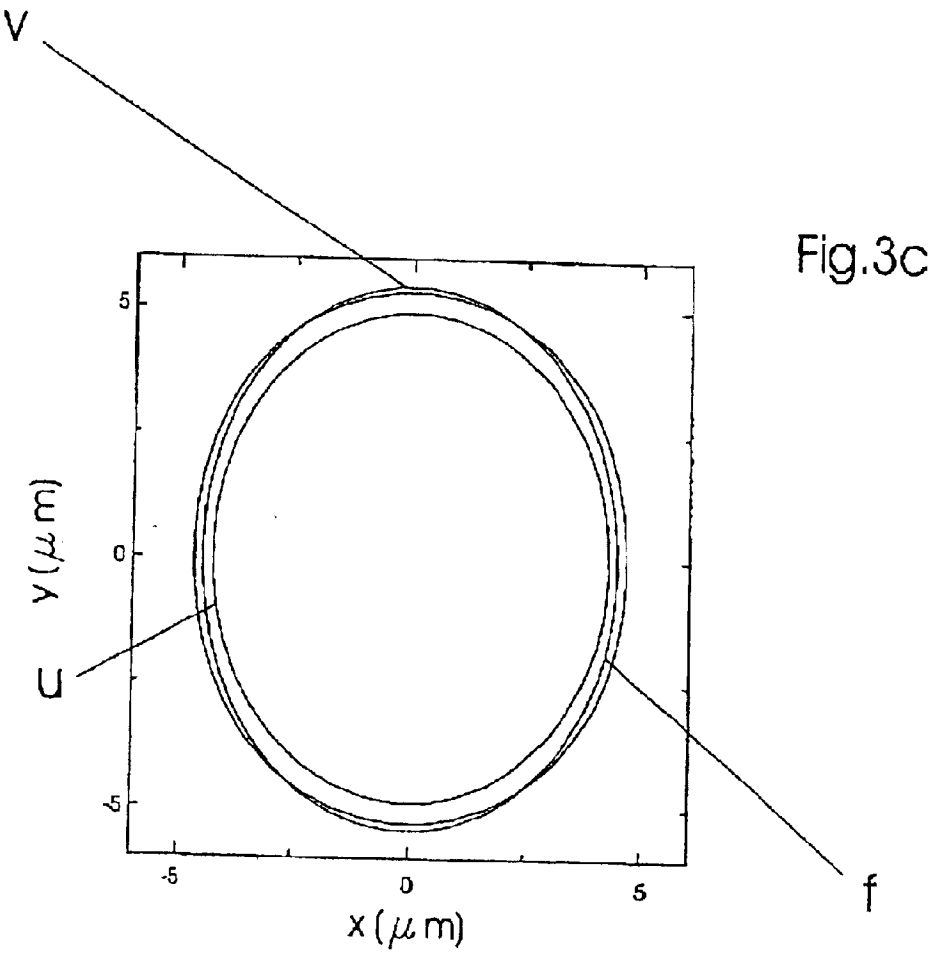

FIGS. 3*a*, 3*b*, and 3*c* show examples of boundary lines of written printing spots of different laser parameters. In other words: the surface is shown on which the threshold intensity for imaging is exceeded. FIG. 3*a* depicts boundary line f of a printing spot having widths $d_x$of 9.3 micrometers and $d_y$of 10.6 micrometers. The shown printing spot having boundary line f is generated by an elliptical laser beam in focus with spot diameters $w_x$=8.0 micrometers and $w_y$=6.0 micrometers. Also shown is boundary line u of a printing spot as it is produced in the case of a deviation by 100 micrometers from the intended distance while the laser power is maintained constant. Its width $d_x$is 8.5 micrometers and its height $d_y$is 9.8 micrometers. The laser wavelength is approximately 830 nanometers and motion index number $M^2$ is 1.1. At this distance from the focus, spot widths $w_x$ and $w_y$ amount to 8.8 micrometers and 7.7 micrometers, respectively. FIG. 3*a* shows boundary line a of a printing spot as it can be achieved with the aid of the device according to the present invention. To generate a printing spot having the width $d_x$ 9.4 micrometers and a height $d_y$ of 10.7 micrometers at the given actual distance, 100 micrometers away from the focus, the power of the laser is increased by 10 percent. The laser wavelength 830 nanometers and motion index number $M^2$=1.1 are selected to be the same as in the two other cases.

Using the device according to the present invention, it is possible to make the printing spot size variable. FIG. 3*b* depicts, by way of example, how an adjustment of the power can result in a printing spot which is reduced in size. Using reduced power, which is optimized for writing a line, boundary line l of a printing spot having the width $d_x$ of 8.1 micrometers and the height $d_y$ of 9.5 micrometers is generated. Again, the actual distance deviates by 100 micrometers from the intended distance at the focal point of the laser. There, spot diameter $w_x$ is 8.8 micrometers and spot diameter $w_y$ is 7.7 micrometers.

FIG. 3*c* depicts, by way of example, how a prolongation in the exposure time, in other words, in the time duration of the laser beam, results in an increase in size of the printing spot both in the x-direction and in the y-direction. Besides boundary lines f and u (exposure at the focal point and 100 micrometers out of focus, respectively), a boundary line v can be seen which is generated in the case of a prolongation in the exposure time from 10 microseconds to 11 microseconds. The spot generated in this manner has the widths $d_x$ of 9.5 micrometers and $d_y$ of 10.8 micrometers. The parameters of the generating beam are the same as for the beam which generates a printing spot having boundary line u as is shown in FIG. 3*a* as well.

The shown series of images in FIGS. 3*a*, 3*b*, and 3*c* exemplarily depicts how a spotwise imaging of printing surfaces with the aid of at least one laser beam with variable printing spot size is achieved by a variable printing spot size or exposure time. Changes in the distance between the printing surface and the laser focus are compensated for by adjusting the input laser power to adjust the laser power instead of by a movement of the imaging optics, of the laser itself, or of the printing surface as is usual in autofocus systems.

Figure 4:
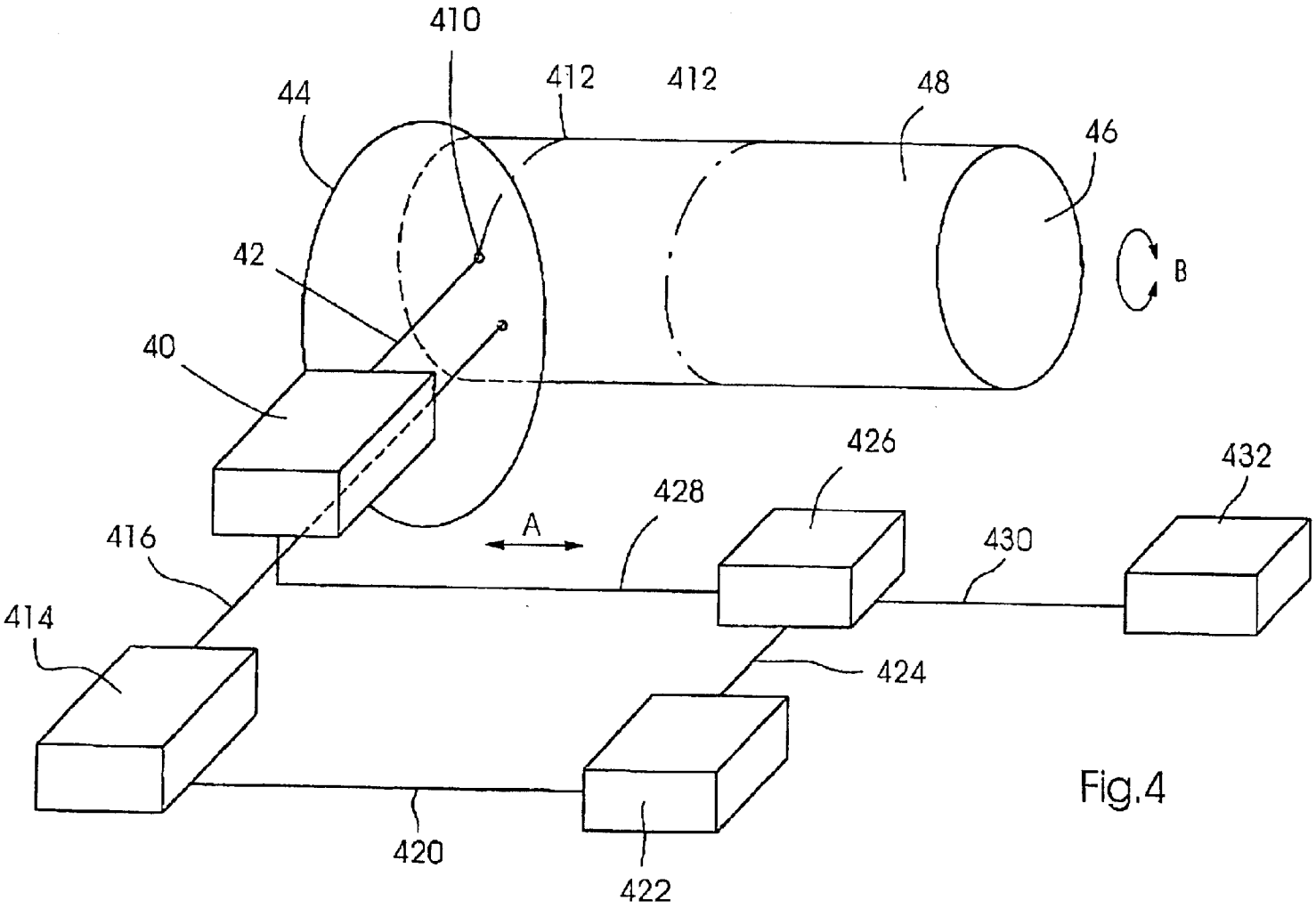
FIG. 4 shows a schematic view of the imaging of a printing surface using a device according to the present invention.

FIG. 4 shows a preferred embodiment of the present invention for the imaging of a printing surface which is located on a rotatable cylinder. An embodiment of this kind can be implemented, in particular, in a printing mechanism or a printing machine. Laser light source 40 generates a laser beam 42 which is imaged, via an imaging optics 44, in spot 410 on printing surface 48 which is located on cylinder 46. Cylinder 46 is rotatable about its axis of symmetry. This rotation is denoted by double arrow B. Laser light source 40 can be moved parallel to the axis of symmetry of cylinder 46 on a linear path, which is indicated by double arrow A. For imaging, cylinder 46 rotates with printing surface 48 according to rotary motion B, and laser light source 40 moves along the cylinder according to translation direction A. An imaging results which runs around the axis of symmetry of cylinder 46 on a helical path. The path of image spot 410 is indicated by line 412. Distance meter 414 emits a light beam 416 which reaches printing surface 48 in image spot 418. In this maimer, it is possible to acquire the required information on the distance of laser light source 40 with image spot 410, which is used for imaging, from printing surface 48. Via a connection for exchanging data and/or control signals 420, distance meter 414 is linked to a device for computing the required laser power 422. Via connection 424, the device for computing the required laser power or exposure time 422 is linked to laser control 426 which is able to determine, in particular, the laser power. Data and/or control signals are transmitted between laser control 426 and laser light source 40 via connection 428.

In a preferred embodiment of the present invention, laser control 426 can, moreover, be linked to machine control 432 via a connection 430.

In an advantageous refinement of the present invention, laser source 40 is composed of a laser diode array whose individual lasers can be controlled separately. Then, it is possible to carry out a simultaneous imaging of a plurality of printing spots whose size is variable. For each individual printing spot, the deviation of the actual position from the intended position of the printing surface relative to the laser focus can be compensated for by means of the variable laser power or exposure time.

LIST OF REFERENCE SYMBOLS

10 Optical axis

12 Beam focus

14 Widened beam in front of focus

16 Widened beam behind focus

18 Variable boundary of the laser spot as a function of the position

110 Imaging region

112 Intensity above threshold at intended distance

114 Actual distance

116 Desired imaging region

118 Intensity above threshold at actual distance

20 Printing surface

22 Spot of the imaging laser

24 Printing spot to be written

26 Focus diameter in the x-direction $w_x$

28 Focus diameter in the y-direction $w_y$

210 Width of printing spot $d_x$

212 Height of printing spot $d_y$

A Translatory motion

B Rotary motion f Boundary line of the printing spot when imaged at the focal point u Boundary line of the printing spot when imaged 100 micrometers out of focus a Boundary line of the printing spot when imaged with adjusted power l Boundary line of the printing spot when imaged 100 micrometers out of focus u Boundary line of the printing spot when imaged with prolonged exposure time

40 Laser light source

42 Laser beam

44 Imaging optics

46 Cylinder

48 Printing surface

410 Image spot

412 Path of image spots

414 Distance meter

416 Beam for distance measurement

418 Image spot of the beam for distance measurement

420 Connection for exchanging data and/or control signals

422 Device for computing the required laser power or exposure time

424 Connection for exchanging data and/or control signals

426 Laser control, in particular, control of laser power or exposure time

428 Connection for exchanging data and/or control signals

430 Connection to machine control

432 Machine control

What is claimed is:

1. A device for spotwise imaging printing surfaces comprising:

a laser light source producing at least one laser beam movable relative to a printing surface, the laser beam defining an image spot on the printing surface, the laser light source having an input laser power; and a laser control varying the input laser power or an exposure time as a function of a distance of the laser light source from the image spot; and a distance meter for determining the distance of the laser light source from the image spot.

2. The device as recited in claim 1 wherein the laser light source includes a diode laser.

3. The device as recited in claim 1 wherein the laser light source produces a plurality of light beams spatially separated from one another for simultaneous imaging of a plurality of printing spots.

4. The device as recited in claim 1 wherein the laser light source includes an individually controllable diode laser array.

5. A method for imaging printing surfaces using laser light comprising the steps of:

providing a laser light source for generating a laser beam having a position-dependent intensity distribution in two spatial directions perpendicular to a propagation axis, and a specific divergence;

providing a printing surface at a distance from the laser light source;

measuring the distance of the laser light source from the printing surface;

exposing the printing surface located at a certain distance from the laser light source; and varying an input laser power or exposure time so as to vary a spot size of image spots on the printing surface, wherein the varying of the laser power or exposure time is a function of the distance of the laser light source from the image spot on the printing surface.

6. A method for generating printing spots of desired size comprising the steps of:

providing a laser light source for generating a laser beam having a position-dependent intensity distribution in two spatial directions perpendicular to a propagation axis, and a certain divergence;

providing a printing surface at a distance from the laser light source;

measuring the distance of the laser light source from the printing surface;

adjusting the spot size to a predetermined value by varying the input laser power or exposure time, wherein the varying of the laser power or exposure time is a function of the distance of the laser light source from the image spot on the printing surface.

7. A printing unit comprising:

a printing surface; and a device for spotwise imaging the printing surface, the device having a laser light source producing at least one laser beam movable relative to a printing surface, the laser beam defining an image spot on the printing surface, the laser light source having an input laser power, the device also including a laser control varying the input laser power or an exposure time as a function of a distance of the laser light source from the image spot and a distance meter for determining the distance of the laser light source from the image spot.

8. A printing machine comprising:

at least one printing unit, the printing unit including a printing surface; and a device for spotwise imaging the printing surface, the device having a laser light source producing at least one laser beam movable relative to a printing surface, the laser beam defining an image spot on the printing surface, the laser light source having an input laser power, the device also including a laser control varying the input laser power or an exposure time as a function of a distance of the laser light source from the image spot and a distance meter for determining the distance of the laser light source from the image spot.

9. A device for spotwise imaging printing surfaces comprising:

a laser light source producing at least one laser beam movable relative to a printing surface, the laser beam defining an image spot on the printing surface, the laser light source having an input for altering the laser power; and a laser control varying the input as a function of a distance of the laser light source from the image spot; and a distance meter for determining the distance of the laser light source from the image spot.

* * * * *